US006868887B2

(12) United States Patent
Harte et al.

(10) Patent No.: US 6,868,887 B2
(45) Date of Patent: Mar. 22, 2005

(54) LABELING DEVICE HAVING ENHANCED SANITARY DESIGN

(75) Inventors: James A. Harte, Shawnee, KS (US); John Scott Nixon, Independence, MO (US)

(73) Assignee: Koch Equipment LLC, Kansas City, MO (US)

( * ) Notice: Subject to any disclaimer, the term of this patent is extended or adjusted under 35 U.S.C. 154(b) by 0 days.

(21) Appl. No.: 10/731,306

(22) Filed: Dec. 9, 2003

(65) Prior Publication Data

US 2004/0250960 A1 Dec. 16, 2004

Related U.S. Application Data

(63) Continuation-in-part of application No. 10/460,711, filed on Jun. 12, 2003.

(51) Int. Cl.[7] ..... B65C 9/08; B65C 9/26; B65C 9/36

(52) U.S. Cl. ..... 156/539; 156/247; 156/556; 156/557; 156/DIG. 37; 156/DIG. 42

(58) Field of Search ..... 156/247, 249, 156/389, 538–542, 556, 557, 566, 391, DIG. 28, DIG. 37, DIG. 42, 229, 230, 580; 269/21; 492/30, 37

(56) References Cited

U.S. PATENT DOCUMENTS 3,379,466 A * 4/1968 Hughes ..... 294/65
4,046,613 A * 9/1977 Kucheck et al. ..... 156/249
4,680,082 A * 7/1987 Kearney ..... 156/497
5,281,296 A * 1/1994 Beliveau ..... 156/542
5,401,231 A * 3/1995 Hebert ..... 492/37
6,006,808 A * 12/1999 Ewert et al. ..... 156/556
6,149,755 A * 11/2000 McNichols et al. ..... 156/264
6,634,404 B2 * 10/2003 Simon ..... 156/556

* cited by examiner

*Primary Examiner*—Sue A. Purvis
(74) *Attorney, Agent, or Firm*—Hovey Williams LLP

(57) ABSTRACT

A labeling device (20) is provided which is especially designed for use as a transverse labeler with in-line packaging machines (22). The device (20) includes a label dispensing unit (34), and a transport and tamping assembly (36) with a tamping assembly (68). The assembly (68) has a plurality of side-by-side hollow upright plates (78) presenting label-engaging ends (80) and remote ends (82), with the plates (78) secured with movement in unison to a slotted crosspiece (84); an air cylinder assembly (98) is coupled with the crosspiece (84) for selective movement of the plates (78). Apparatus (100) is also provided for creating reduced pressure conditions at the ends (80) of the plates (78), including fans (104) oriented to draw air through the hollow plates (78). The transport and tamping assembly (36) is adjustably mounted to the labeler frame (38) in order to permit selective adjustment of the assembly (36). Specialized rollers (134) having perforate roller bodies (136) and supporting bearings (140) are used in the web-handling portion of the preferred device (20).

34 Claims, 10 Drawing Sheets

LABELING DEVICE HAVING ENHANCED SANITARY DESIGN

CROSS-REFERENCE TO RELATED APPLICATION

This is a continuation in part of application Ser. No. 10/460,711 filed Jun. 12, 2003.

BACKGROUND OF THE INVENTION

1. Field of the Invention

The present invention is broadly concerned with improved labeling devices designed for use with packaging equipment. More particularly, the invention is concerned with transverse labeling devices of the kind typically used with in-line packaging machines such as form, fill and seal machines and wherein the labeling devices are simpler and can be more readily cleaned and serviced, as compared with existing labelers. The preferred labeling devices of the invention also are readily adjustable so as to accommodate packages of varying sizes, leading to reduced cycling times while essentially eliminating variations in labeling impacts.

2. Description of the Prior Art

U.S. Pat. No. 6,543,505 describes highly successful Crossweb™ labeling devices designed to apply labels on-line to packages in form, fill and seal thermoform packaging machines. The devices of the '505 patent are capable of using labels of a single roll and to apply the labels at a 90 degree angle to any package array. The device uses separate stepper motors for label web advancement and label peeling, for transporting, separating and applying the labels, and for selectively indexing the entire system to label multiple rows.

As described in the '505 patent, the label tamping assembly makes use of an enclosed box with fans attached to create a vacuum which holds separated labels to transport belts. A plurality label tamp blades are positioned within the box and are connected to an air cylinder actuator. In operation, separated labels are positioned on the transport belts and the blades are shifted so as to move the labels into contact with the packages. Use of the enclosed vacuum box presents several problems. Any labels that are not properly adhered to the packages tend to be drawn back into the fan box by the fans, eventually blocking the fans and requiring the entire system to be cleaned out to remove the waste labels. Additionally, these labelers are often used in food plants (e.g., for the labeling of meat or cheese packages), necessitating daily equipment washdowns. The enclosed space defined by the vacuum box in these labelers thus presents a sanitation issue.

Additionally, in the current labeling devices the transport and tam ping assembly is rigidly mounted to the frame of the labeler which is then mounted across either the top or the bottom of a packaging machine (depending upon which side of the packages are being labeled). Owing to variations in the frames of the packaging machines and the depths of different product packages, the tamp unit stroke must be long enough to reach a variety of distances. Usually, the stroke length will have a length of at least 200 mm, and sometimes up to 250 mm. The required tamp stroke is typically restricted only by the package labeling surface and the air cylinder itself does not normally extend its full stroke. In order to regulate the impact strengths of the tamp unit between different packages, flow control restrictions and precise regulation of the cylinder valve firing time are used.

These expedients present a number of practical problems. The first is tamp cycle time. The longer the stroke of the label tamp, the slower the machines cycle time will be. Another problem is variation in impact strength of the tamp, i.e., attempts to control the impact strength using time and flow controls makes the system very dependent on constant air pressure from a plant source, which is often not reliable. Thus the first tamp of a cycle tends to be stronger than the subsequent tamps, due to pressure buildup in the system.

An additional problem with conventional labeling equipment stems from the use of conventional, imperforate rollers in the label-handling apparatus. Such rollers tend to become fouled with scrap labels making them difficult to clean and maintain. A related issue is that such rollers are supported on regular bearings which are themselves hard to adequately clean. Thus, there is a tendency towards accumulation of bacteria on these bearing assemblies. Prior art rollers are not designed for such easy cleaning and sanitation, see, e.g., U.S. Pat. Nos. 3,991,440, 5,306,131, 6,149,755, 6,126,583, 5,358,233, 6,432,030, 5,388,489, 5,414,914, 5,736,089, 5,649,890, 5,021,111, 4,868,958, 4,584,747, 4,607,947, 3,597,818 and 4,848,079.

There is accordingly a need in the are for an improved labeling device which overcomes the problems inherent in the use of a vacuum-box type of tamping unit, while moreover alleviating problems associated with rigid mounting of the transport and tamping assembly, such as cycle times and variable impact strengths. Additionally, there is a need for improved roller devices for use in the label transport assemblies of labelers which can be more readily cleaned and maintained.

SUMMARY OF THE INVENTION

The present invention overcomes the problems outlined above and provides improved labeling devices of the type commonly used with in-line packaging equipment. Broadly speaking, the labeling devices of the invention include a label dispensing unit operable to deliver labels to a label delivery location, together with a label transport and tamping assembly operable to receive labels from the unit and to apply the delivered labels to packages or the like. The transport/tamping assembly includes a plurality of an adjacent, hollow bodies each presenting a label-engaging end; the bodies are shiftable between a label-receiving position and a label-applying position during operation of the device. Apparatus is also provided to create reduced pressure conditions at the label-engaging ends of the bodies when the latter are in the label-receiving position thereof.

In preferred forms, the shiftable bodies are in the form upright, hollow plates located in the side-by-side adjacency, with the plates including internal baffle structure to assure even air flow therethrough. The respective plates are secured together for movement as a pack or assembly, and a fan assembly is located adjacent the remote ends of the plates to draw air through the latter.

In operation, labels are moved to a label pickup location on the transport/tamping assembly and the hollow plate assembly is shifted so as to engage and move the labels into a label-applying location against packages. Again, air is drawn through the individual plates when they are retracted, in order to hold the labels in position for accurate attachment to packages.

In another aspect of the invention, a labeling device is provided including a dispensing unit and a label transport/tamping assembly, the latter having a plurality of adjacent bodies shiftable between a label-receiving and a label-applying position. The labeler also includes a support assembly, with the transport/tamping assembly being operably coupled with the support to permit adjustment of the transport/tamping assembly as a hold relative to the support assembly. In this fashion, the transport/tamping assembly may be adjusted to accommodate packages of varying depths while maintaining the same stroke length, thus minimizing labeler cycle times while assuring that the impact forces are substantially constant in all modes of operation.

Improved, perforate roller devices are also proved which find particular utility in the label transport portion of the labeler. Such devices include an elongated, rotatable tubular roller body provided with relatively large, spaced apart openings therein. These roller bodies are preferably supported on specialized bearings having glass rollers running on synthetic resin races, with slight spaces provided between the rollers. This makes it possible to readily clean the entire roller device, both inside and outside, using normal spray equipment.

DETAILED DESCRIPTION OF THE PREFERRED EMBODIMENT

Figure 1:
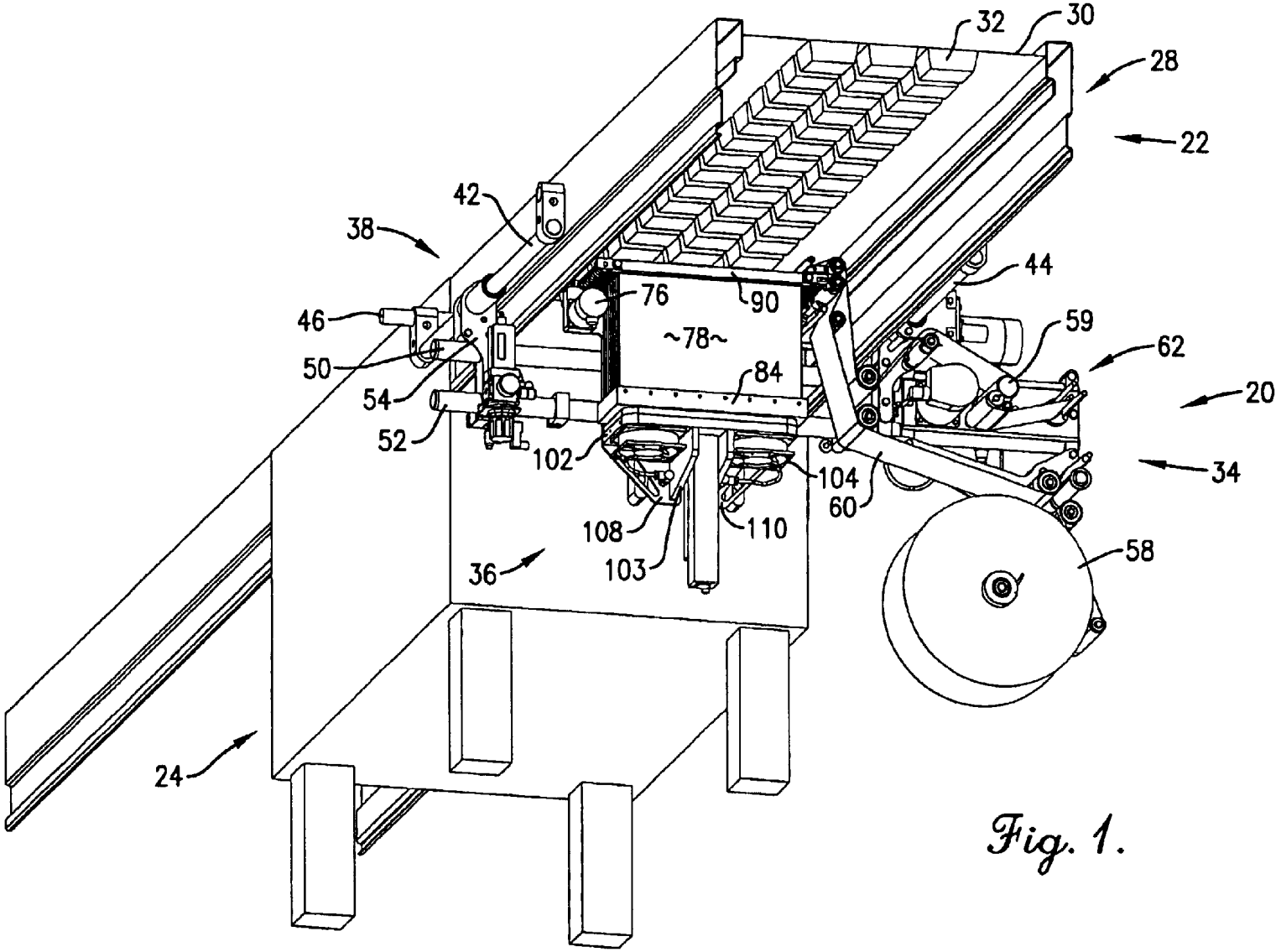
FIG. 1 is a somewhat schematic, isometric view of portions of a form, fill and seal packaging machine equipped with the preferred labeling device of the invention.
Figure 2:
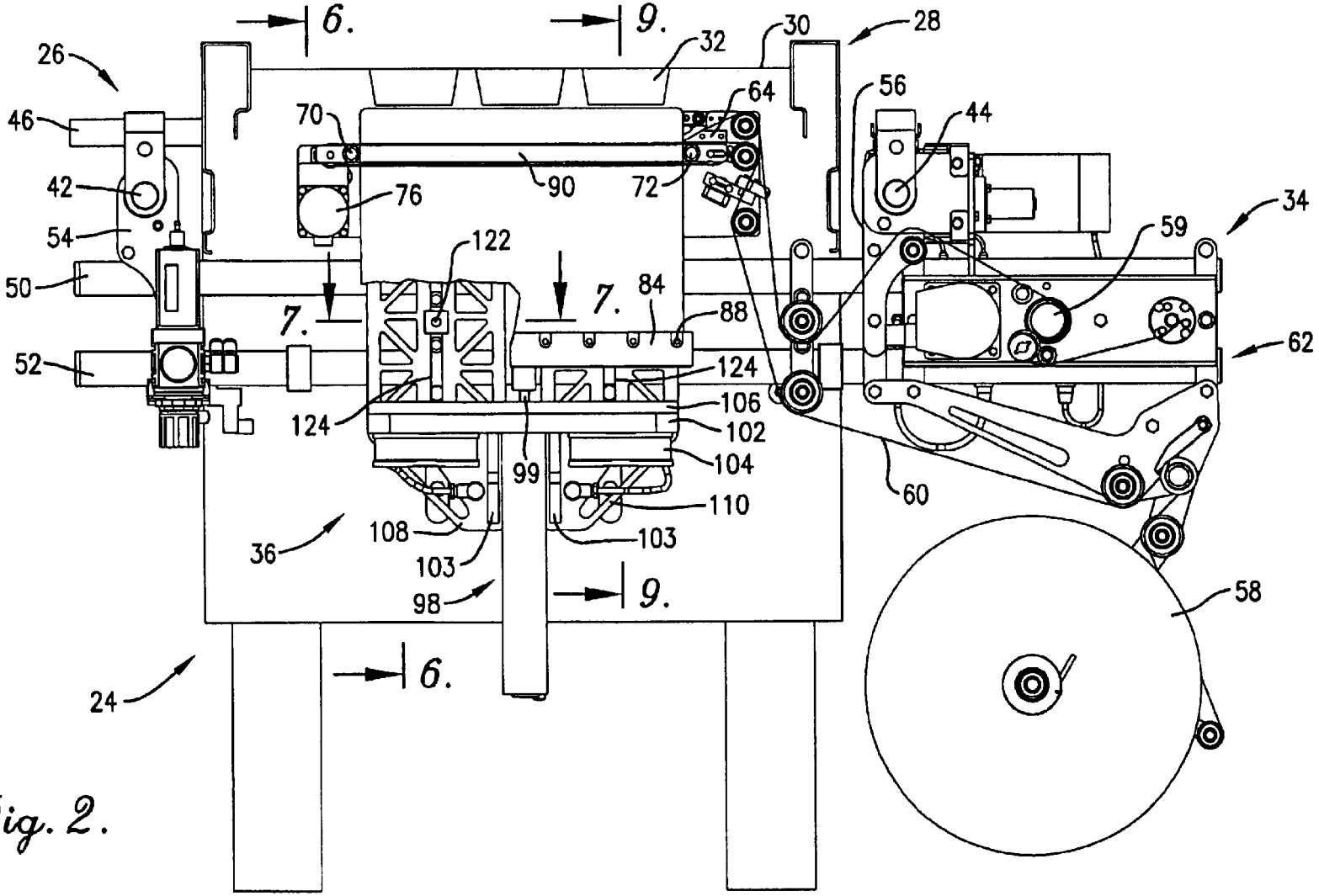
FIG. 2 is a fragmentary front elevational view of the machine depicting in FIG. 1, illustrating in more detail the construction of the labeling device, the latter shown in its extended labeling position.
Figure 3:
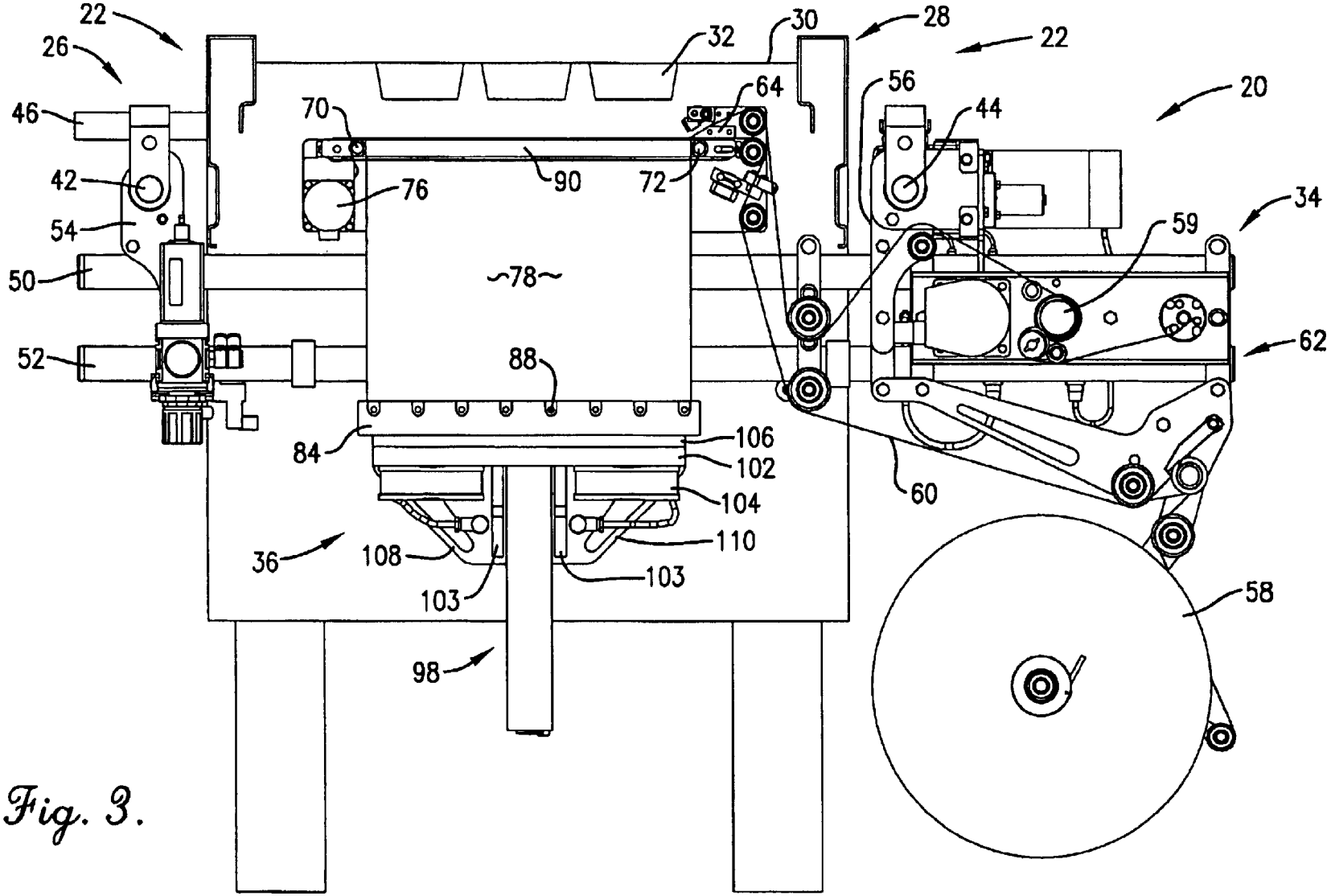
FIG. 3 is a view similar to that of FIG. 2 but illustrating the labeling device in its retracted position.

Turning now to FIG. 1, a labeling device 20 in accordance with the invention is shown in its operative location along the underside of an otherwise conventional form, fill and seal packaging machine 22. The machine 22 includes a schematically illustrated lower frame 24 as well as laterally spaced apart, fore and aft extending side rails 26 and 28. The machine 28 is designed to incrementally advance via powered roller chains a synthetic resin web 30 between an initial forming station wherein packages 32 are heat formed, and thence through a filling station where product is placed within the packages 32. At this point the filled packages are advanced to a sealing station where a top web is affixed to the filled packages 32. Thereafter, the sealed packages are separated and placed into cartons or the like for shipping. During course of operation of the machine 22, it is common to attach labels either to the undersides of the packages 32 and/or to the top web. In the illustrated FIG. 1 embodiment, it will be observed that the device 20 is mounted for application of labels to the bottoms of the packages 32. However, those skilled in the art will readily appreciate that the device 20 could be mounted above the machine 22 if desired.

Figure 5:
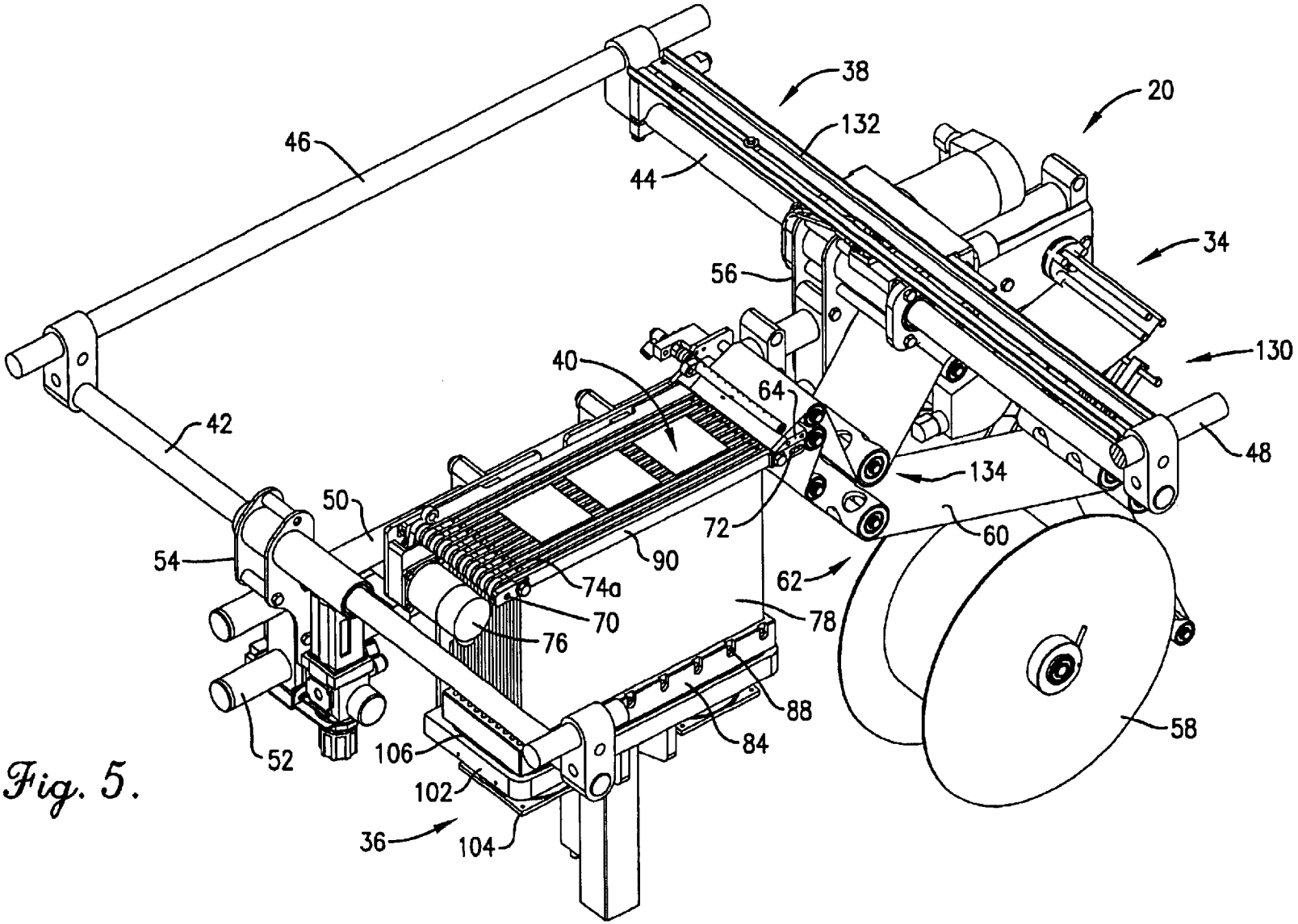
FIG. 5 is a fragmentary isometric view depicting the labeling device apart from a form, fill and seal packaging machine.

Broadly speaking, the labeling device 20 includes a label dispensing unit 34 as well as a label transport and tamping assembly 36; the unit 34 and assembly 36 are supported by a frame assembly 38 best illustrated in FIG. 5. As indicated, the function of device 20 is to apply adhesive-coated labels 40 (see FIG. 5) to the packages 32 in synchronization with the operation of the overall machine 22.

In more detail, the frame assembly 38 includes elongated, fore and aft extending side rail bars 42 and 44, together with transverse cross bars 46 and 48. Additionally, a pair of vertically spaced apart, transversely extending stabilization bars 50 and 52 are provided, the latter being operatively connecting to rail bars 42 and 44 by means of shiftable couplers 54 and 56. The frame assembly 38 is operatively secured to the machine 22 by conventional means.

The label dispensing unit 34 is itself known and includes a label supply reel 58 for holding and dispensing an elongated label web 60 bearing spaced labels 40 thereon, with a takeup roller 59 to recover the web 60 Additionally, a stepper motor-controlled, multiple-roller dancer or tensioning assembly 62 is provided between reel 58 and roller 59 for supporting the web 60 during advancement thereof while controlling the tension of web 60 during label delivery. A wedge-shaped label peelbar 64 is located at a label delivery location in order to detach the label 40 from web 60 in the usual fashion.

The transport and tamping assembly 36 includes a multiple-belt label mover 66 designed to receive detached, adhesive side up labels 40 from the unit 34, and to move the labels into a position for engagement and shifting thereof for labeling of the packages 32. Also, the overall assembly 36 includes a tamping assembly 68 associated with mover 36 and operable to engage and rapidly move the labels 40 from the mover 66 and into labeling engagement with the packages 32. In particular, the mover 36 includes a pair of endmost belt shafts 70 and 72 supporting a plurality of continuous, spaced apart belts 74, the latter each presenting an outermost label-supporting run 74*a* and an inboard run 74*b*. The belts are movable through the medium of stepper motor 76 coupled with shaft 70 in timed relationship with the remainder of the device 20.

Figure 9:
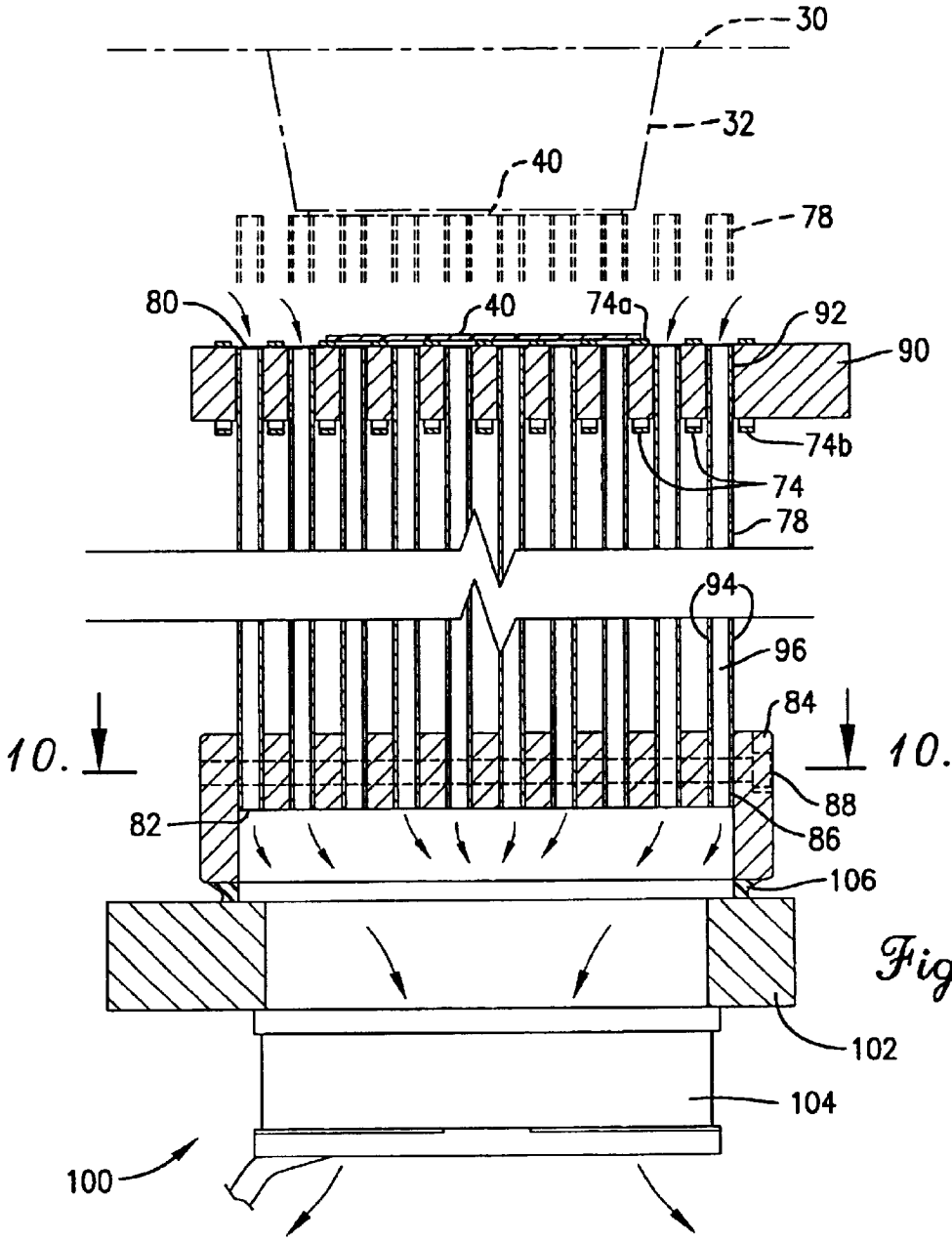
FIG. 9 is a fragmentary vertical sectional view taken along line 9—9 of FIG. 2.
Figure 10:
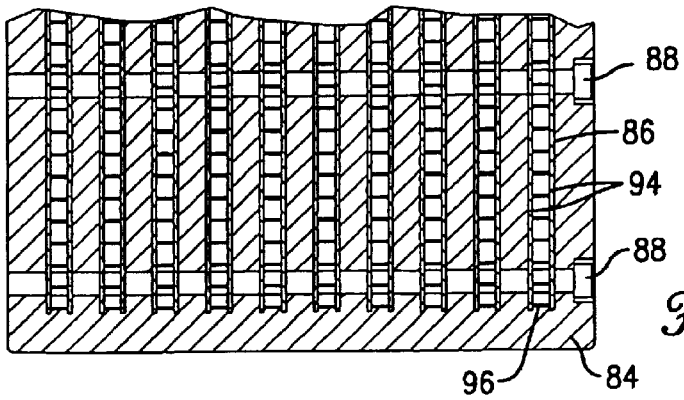
FIG. 10 is a sectional view taken along line 10—10 of FIG. 9 and depicting the internal baffle construction of the labeling device plates.

The tamping assembly 68 has a plurality of upright, laterally extending, spaced apart, hollow plates 78 which each have an open labeling end 80 and an opposed, open remote end 82. As best seen in FIGS. 9 and 10, the plates 78 are in side-by-side adjacency and are shiftable in unison as a pack or assembly. To this end, the plates are secured adjacent the remote ends 82 thereof to a crosspiece 84 provided with spaced slots 86 accommodating the respective plates 78, with couplers 88 securing the plates in place. A slotted manifold 90 is also provided adjacent the labeling ends 80 of the plates 78, and has slots 92 formed therein to slidably receive the latter. As illustrated, the manifold 90 is located between the shafts 70, 72 and the runs 74*a* and 74*b* of the belts 74, with the latter on opposites sides of the respective plates 78.

Referring to FIGS. 9 and 10, it will be seen that each of the plates 78 includes spaced apart flat panels 94 with internal, elongated baffles 96 extending between the panels. The baffle structure is used to even airflow through the individual plates 78 and to prevent "short circuiting" of air during operation. Movement of the plates 78 is effected by means of a cylinder unit 98 which is affixed to the central region of crosspiece 84. The unit 98 has an extensible rod 99 secured to crosspiece 84, and is thus operable to move the plates 78 relative to manifold 90 and through the slots 92 between a retracted position (FIG. 9) awaiting receipt of label(s) 40, and an extended position shown in phantom in FIG. 9 where the label(s) 40 are pressed into engagement with the packages 32 to adhesively secure the labels in place.

The overall assembly 68 also includes apparatus 100 for drawing air through the plates 78 in order to create reduced pressure conditions adjacent the open ends 80 thereof. The apparatus 100 has an apertured fan mount 102 supporting a pair of electrically operated fans 104; as shown, the mount 102 also includes gussets 103 supporting the cylinder unit 98. A circumferential sealing gasket 106 is provided between the adjacent peripheries of the crosspiece 84 and fan mount 102. Operation of the fans 104 thus serves to draw air through the plates 78 as explained.

Figure 6:
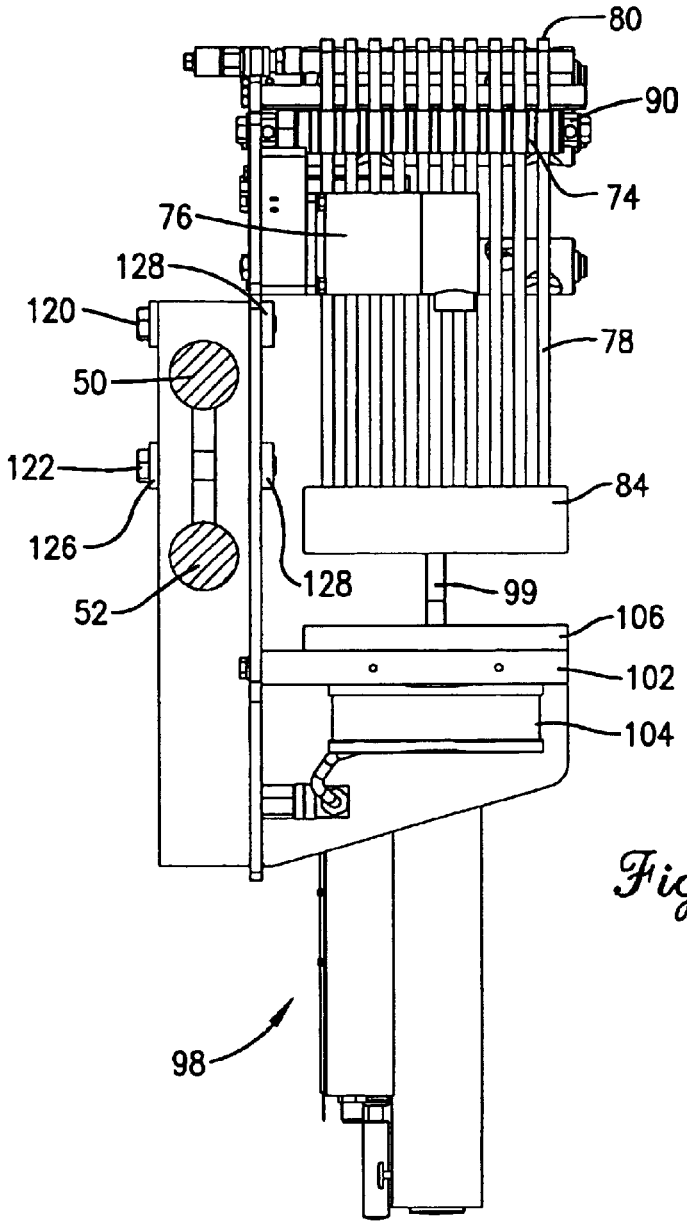
FIG. 6 is a vertical sectional view taken along line 6—6 of FIG. 2.
Figure 7:
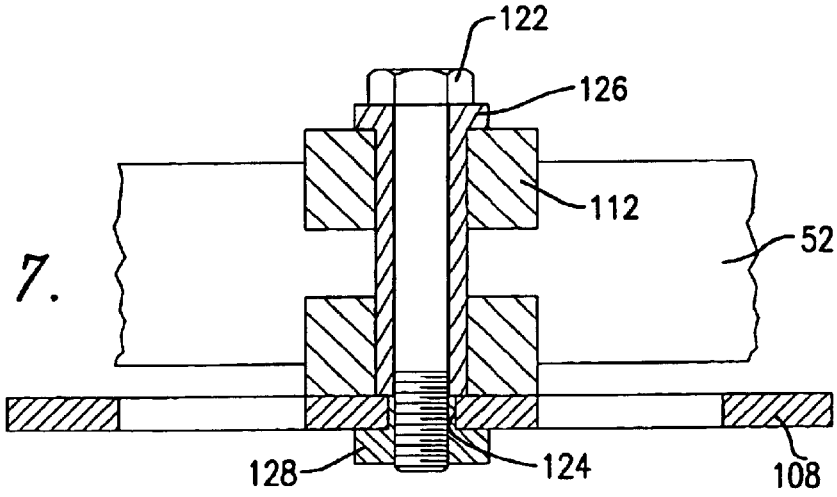
FIG. 7 is a horizontal sectional view taken along line 7—7 of FIG. 2.
Figure 8:
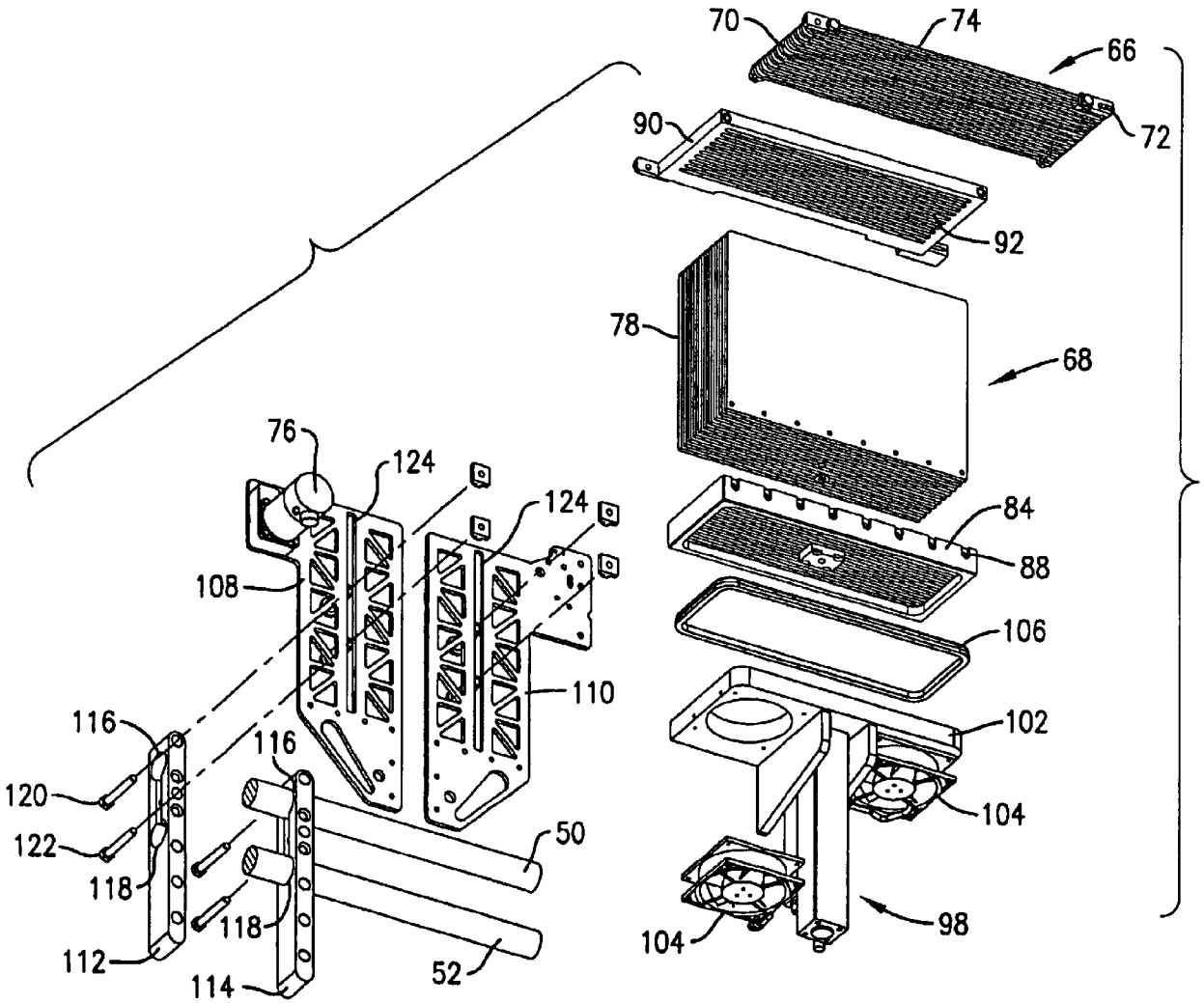
FIG. 8 is a fragmentary exploded view illustrating components of the preferred labeling device.

Referring to FIGS. 6 and 8, it will be seen that the assembly 36 is supported on a pair of apertured backplates 108 and 110 so as to permit up and down adjustment of the assembly 36 as required. Specifically, the back plates, 108 and 110 are secured to the bars 50 and 52 by means of upright mounting elements 112 and 114. Thus, each of the elements includes a pair of vertically spaced apart openings 116 and 18 which receive the bars 50 and 52. A pair of upper bolts 120 and 122 extend through openings 119 in the elements 112 and 114 and pass through an elongated, upright slot 124 provided in each backplate 108 and 110. The bolts are received within bushings 126 located within the openings 119 (FIG. 7) an extend through the slots 124. Threaded connectors 128 are attached to the ends of the bolts as shown, with the connectors mating with the slots 124.

The preferred mounting structure for the assembly 36 provides a number of important advantages. First, the stroke of cylinder 98 can be shortened as to compare with prior labelers (75 mm vs. 200–250 mm). Also, the tamp assembly stroke can be adjusted to the exact extension of the cylinder, allowing the device 20 to operate with the cylinder operating at its full but much shorter stroke. Hence, the shortened tamp length allows faster and constant cycling times, not withstanding variations in package size. Moreover, the adjustability of the assembly 36 solves the issue of variations in tamp impact. Allowing the cylinder 98 to operate at full stroke permits the cylinder to utilize its air cushion at the end of each stroke. This in turn allows the system to be operated at higher cylinder pressures but without encountering issues of valve timing and associated cylinder sensitivity.

The preferred device 20 is also equipped with mechanism for selective fore and aft movement of the device for registration with respective laterally extending rows of packages to be labeled. This mechanism is in the form of a shifting assembly 130 secured to side rail bar 44 and operatively coupled to the device. The assembly 130 includes a continuous belt member 132 powered by a stepper motor or similar device, with the unit 34 and assembly 36 secured to the belt.

It will be appreciated that control for the positioning and the operation of the labeling device 20 is provided by means of microprocessor-controlled sensors and actuation units such as stepper motors. Normally, the unit 34 and assembly 36 would be controlled by separate microprocessors, in a master-slave operation, with the assembly 36 acting as the master and the dispensing unit acting as the slave. Thus, assembly 36 would typically call the label dispensing unit 34 when label(s) are needed. Further, the shifting assembly 130 would be controlled by its own microprocessor and would operate as a slave, being called by the microprocessor associated with assembly 36.

Figure 13:
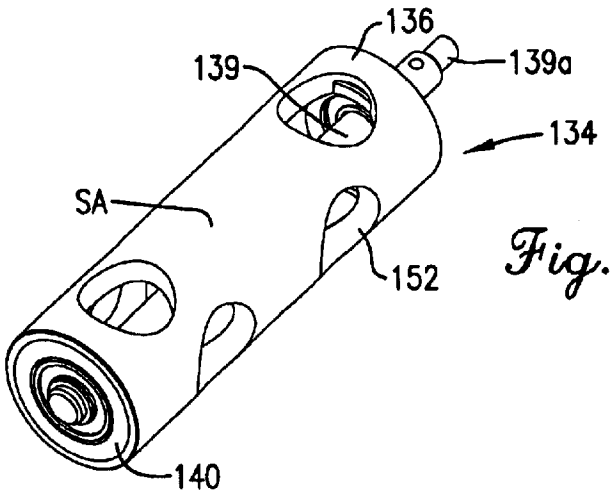
FIG. 13 is a perspective view of one of the preferred roller devices.
Figure 14:
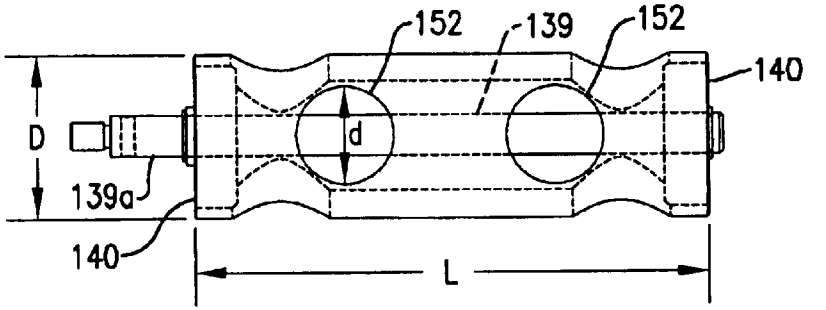
FIG. 14 is an elevational view of one of the roller devices, with the internal construction thereof depicted in phantom.
Figure 15:
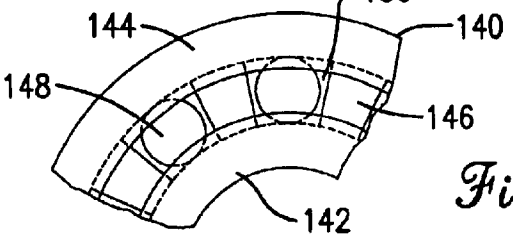
FIG. 15 is an enlarged, fragmentary view illustrating the construction of the preferred bearing assembly used in the perforate roller devices of the invention.

The multiple-roller assembly 62 includes a plurality of specially designed, perforate rollers 134 for supporting the web 60. Referring to FIGS. 13–15, the construction of the rollers 134 is illustrated. In particular, each such roller includes an elongated, tubular, substantially hollow roller body 136 presenting a length L, an outside diameter D (see FIG. 14) and a surface area 138. The body 136 is supported for rotation on an elongated, axially extending shaft 139 presenting an outwardly extending coupler 139*a*. The ends of the body 136 are equipped with special bearing units 140 which receive shaft 139 and permit rotation of the body 136. Referring to FIG. 15, it will be seen that each bearing 140 includes an inner, synthetic resin race 142 as well as an outer race 144. A plurality of synthetic resin spacers 146 are situated between the races 142, 144. Further, a series of glass or synthetic resin balls 148 are positioned between each adjacent pair of spacers 146. As illustrated in this Figure, the bearing 140 is designed so that small through-areas 150 are provided between the respective balls 148 and spacers 146.

It will also be seen that the roller body 136 has a series (here 8) of relatively large openings 152 formed therein. For purposes of the present invention, it has been found that certain dimensional relationships between the body 136 and the openings 152 should be established. In particular, the openings 152 should present a largest transverse dimension which is related to the outside diameter D of the body 136. Again referring to FIG. 14, it will be seen that in the context of the circular openings 152, the largest transverse dimension is of course the diameter d thereof. Hence, the ratio of d/D is preferably greater than about 0.4, more preferably from about 0.4–0.8 and most preferably from about 0.5–0.7. In addition, a relationship should be maintained between the total surface area SA defined by the body 134 (including therein the area represented by the openings 152 if the roller body were imperforate) and the total void area VA presented by the openings 152. Thus, the total surface area SA of the body 136 is calculated using the circumference of the body times the length thereof, and the void areas VA presented by the openings 52 is calculated using the radius of the openings. In practice, it has been found that the ratio of the total void area VA presented by the openings 152 divided by the total surface area SA of the body should be from about 0.12–0.50, and more preferably from 0.16–0.20.

The specific roller illustrated in the drawings has an outside diameter D of 0.94 inches, and length L of 2.95 inches, and the openings 152 have a diameter of 0.28 inches. Using the foregoing ratios therefore, the body 136 has a d/D ratio of about 0.6 and a VA/SA ratio of about 0.17.

Figure 11:
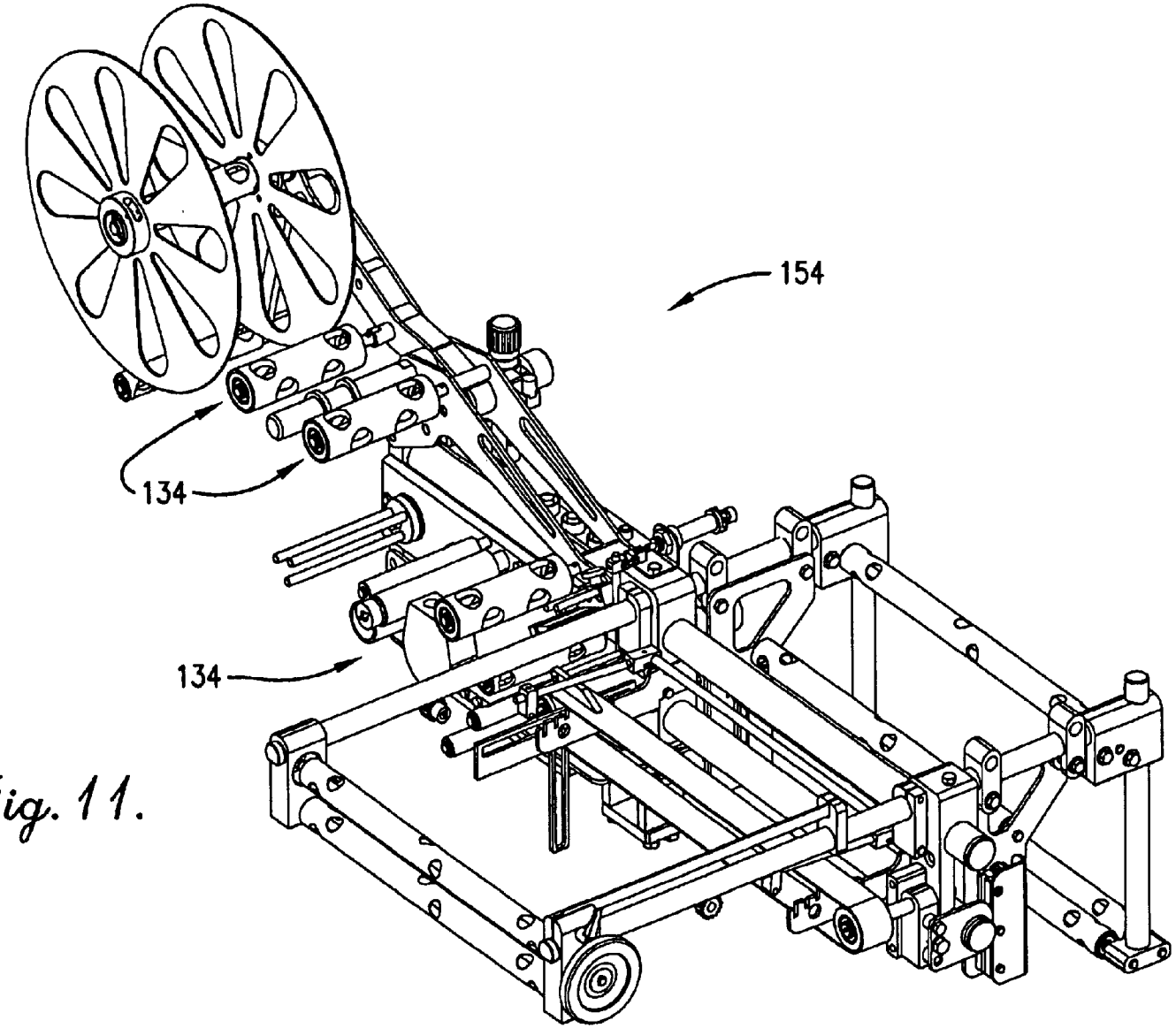
FIG. 11 is a perspective view of a typical film labeling device, showing the use of the preferred roller devices of the invention.
Figure 12:
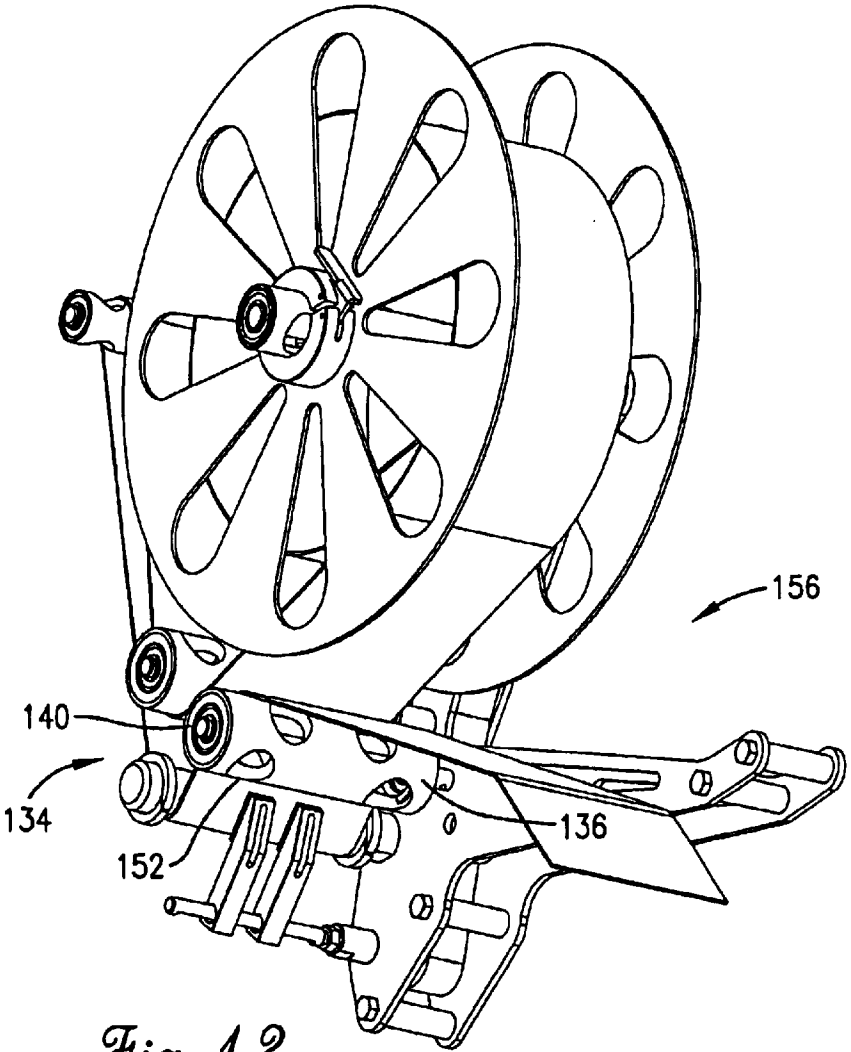
FIG. 12 is a perspective view depicting use of the preferred roller devices on a commonly employed label unwind unit.

The rollers 134 can be used to good effect in all types of labeling equipment. This is shown in the labeling device 20 of FIGS. 1–10, but also in connection with the otherwise conventional film labeling device 154 shown in FIG. 11 and in the label unwind unit 156 of FIG. 12.

Operation

The operation of labeling device 20 will next be described, in the context of a "three-across" labeling sequence. In the first step, the machine 22 indexes web 30 forwardly to labeling station occupied by device 20. In the illustrated embodiment the device 20 is beneath the web and located for labeling of the bottoms of the preformed packages 32. At this point the device 20 comes into play by first delivering three labels 40 to the assembly 36 so that the labels assume the spaced apart position depicted in FIG. 5 where the adhesive side of the labels is up. Such label delivery involves shifting of the label-bearing web 60 from reel 58 through tensioning assembly 68 and with the labels 40 being peeled from the web 60 by peelbar 64. Simultaneously, the label mover 66 is actuated through stepper motor 76 so as to sequentially move the belts 74 leftwardly as shown in FIG. 5 so that the labels 40 are properly spaced along the length of the belts 74 for ultimate application to the packages 32. It will also be understood that during this operation the fans 104 are activated so as to draw air currents through the respective plates 78; this creates reduced pressure conditions adjacent the ends 80 of the plates in order to hold the labels 40 in place on the belts 74.

In the next step, the tamping assembly 68 operates so as to engage and move the labels 40 into contact with the packages 32. Of course, during the previously described steps plates 78 are in the retracted positions thereof shown in FIGS. 3, 5 and 9, where the ends 80 are below the belts 74. In order to apply labels 40, the control apparatus acetates cylinder unit 98 so as to extend rod 99 and thus move the entire pack or assembly of the plates 78 toward the packages 32. This operation quickly engages the labels 40 and moves the label into adhesive contact with the packages 32, thereby properly labeling the packages. As the plates 78 are shifted away from gasket 106, air is no longer being drawn through the plates 78, thereby facilitating movement and securement of the labels.

Once the initial sets of labels is applied, the unit 98 retracts thereby moving the plates 78 back to their original position in contact with gasket 106. This reestablishes air flow through the plates 78 and makes the unit 20 ready for the next labeling sequence. This may involve further movement of the web 30 to position the next row of packages 32 adjacent the labeling device 20. Alternately, the entire labeling device 20 may be shifted through the medium of assembly 130 to align the device with the next row of packages. In any case, the labeling sequence described above is repeated for this next package row.

Figure 4:
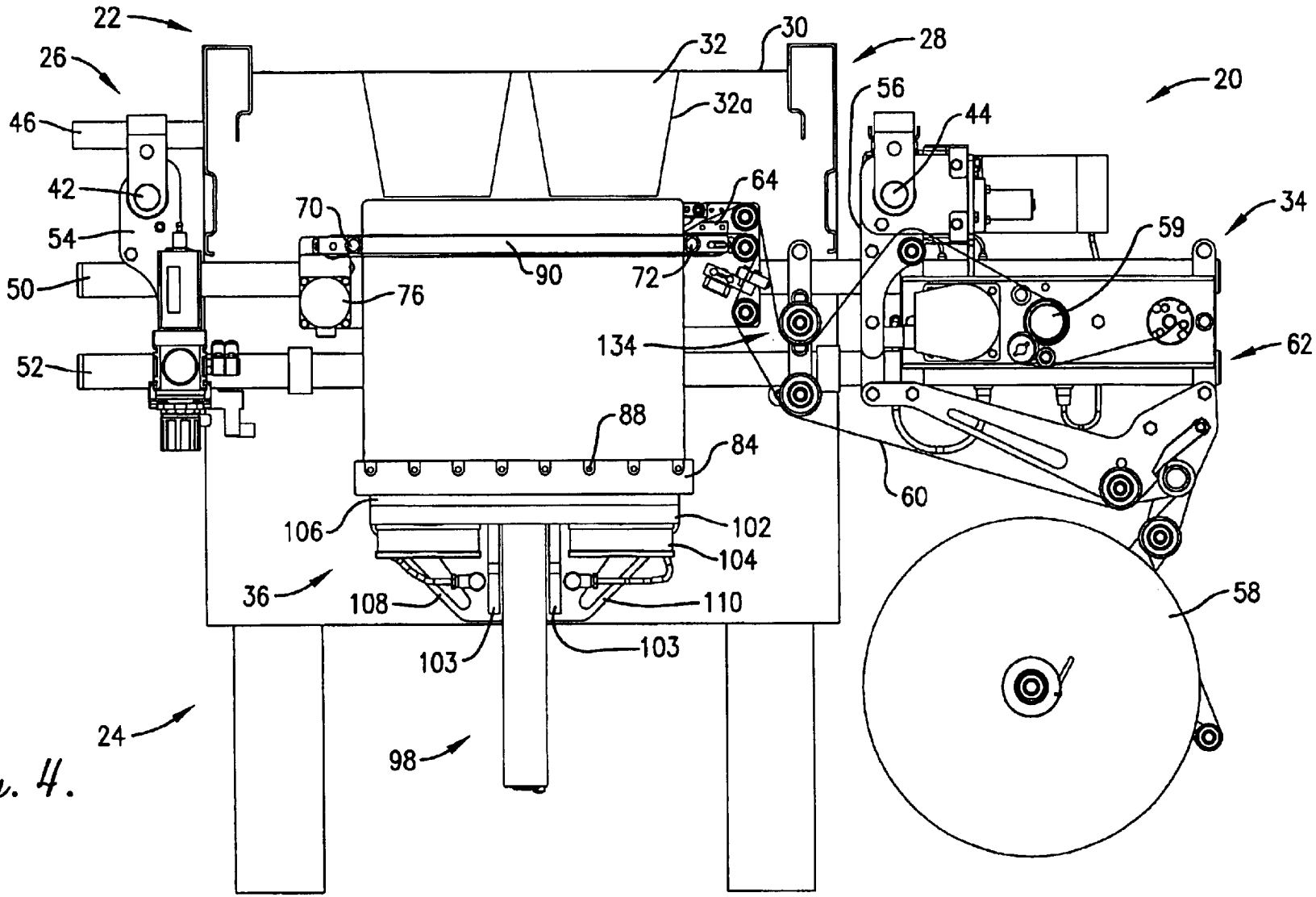
FIG. 4 is a view similar to that of FIG. 2, but showing the labeling device lowered in order to accommodate deeper packages.

The device 20 can also be readily adjusted so as to accommodate packages of different depths. This situation is shown in FIG. 4 where the packages 32*a* are considerably deeper than the packages 32. In order to properly label the packages 32, it is only necessary to vertically adjust the assembly 36 relative to the bars 50 and 52. This involves merely loosening the bolts 120 and 122 associated with each backplate 108 and 110, and sliding the entire assembly 36 downwardly within the backplate slots 124 until the proper position is achieved. The bolts are then retightened to lock the unit 36 in place. The advantage of this shiftability is that the same degree of plate travel between the retracted and extended positions thereof can be used, not withstanding the depths of the packages to be labeled.

The perforate rollers 134 used in the preferred equipment of the invention permit easy and thorough cleaning. That is, during normal washdown, a spray wand can readily be inserted into the openings 152 to clean the interior of the roller. Moreover, the relatively large openings permit easy removal of any label or web fragments which find their way into the roller. The specialized bearings 140 supporting the roller bodies also facilitate such cleanup. This is because cleaning liquid can be sprayed through the through-areas 150.

U.S. Pat. Nos. 6,534,505 and 5,725,717 are expressly incorporated by reference herein.

We claim:

1. A labeling device comprising:

a label dispensing unit operable to deliver labels to a label delivery location; and a label transport and tamping assembly presenting a label-receiving area operable to receive labels from said unit and to apply the delivered labels to packages or the like, said assembly including a stationary member proximate said label-receiving area and a plurality of adjacent, hollow bodies each presenting a label-engaging end, said bodies shiftable relative to said stationary member between a label-receiving position and a label-applying position, and apparatus for creating reduced pressure conditions at said label-engaging ends when said bodies are in said label-receiving position thereof.

2. The device of claim 1, said bodies comprising hollow plates located in side-by-side adjacency.

3. The device of claim 2, said apparatus including a fan assembly located adjacent the ends of said plates remote from said label-engaging ends thereof.

4. The device of claim 2, each of said plates including internal baffle structure for evening airflow through the plates.

5. The device of claim 2, said assembly including a belt assembly presenting a plurality of laterally spaced apart belts each having a label-supporting run and operable to move said labels from said delivery location to a label pickup location, said plates being located between said belts for passage therethrough upon movement of the plates between said label-receiving and label-applying positions.

6. The device of claim 1, said assembly including an actuator for simultaneous shifting of said bodies between said label-receiving and label-applying positions.

7. The device of claim 1, said unit including a label supply reel, a tensioning assembly and a label peelbar adjacent said pickup location.

8. The device of claim 1, including a support assembly, said transport and tamping assembly being operably coupled with said support assembly for adjustment of the transport and tamping assembly as a whole relative to the support assembly.

9. The device of claim 8, said shiftable bodies and apparatus mounted upon at least one slide plate, said slide plate operatively coupled with said support assembly.

10. A labeling method comprising the steps of:

moving labels to a label pickup location; and engaging said labels and moving the engaged labels from the pickup location to a label-applying location in order to apply the labels against packages or the like, said engaging and moving step comprising the steps of providing a label transport and tamping assembly including a stationary member proximate the pickup location and a plurality of adjacent, hollow bodies each presenting a label-engaging end, and shifting said bodies between a label-receiving position at said pickup location and a label-applying position, and creating reduced pressure conditions at said ends when the bodies are in the label-receiving position thereof, the shifting of said bodies being relative to said stationary member.

11. The method of claim 10, said bodies comprising hollow plates located in side-by-side adjacency.

12. The method of claim 11, said reduced pressure creating step including the step of drawing air through the ends of said plates remote from said label-engaging ends thereof.

13. The method of claim 12, including the step of causing said air drawn through said plates to traverse tortuous airflow paths through the plates.

14. The method of claim 11, said assembly including a belt assembly presenting a plurality of laterally spaced apart belts each having a label-supporting run, said plates being located between said belts for passage therethrough upon movement of the plates between said label-receiving and label-applying positions.

15. A labeling device comprising:

a label dispensing unit operable to deliver labels to a label delivery location;

a label transport and tamping assembly presenting a label-receiving area operable to receive labels from said unit and to apply the delivered labels to packages or the like, said assembly including a stationary member proximate said label-receiving area and plurality of adjacent bodies each presenting a label-engaging end and a remote end, said bodies shiftable relative to said stationary member between a label-receiving position and a label-applying position; and a support assembly, said transport and tamping assembly being operably coupled with said support assembly for adjustment of the transport and tamping assembly as a whole relative to the support assembly.

16. The device of claim 15, said shiftable bodies and apparatus mounted upon at least one slide plate, said slide plate operatively coupled with said support assembly.

17. A roller comprising:

an elongated, rotatable, tubular roller body presenting a length L, an outside diameter D, and a total surface area SA; and a pair of spaced-apart bearings supporting the body for said rotation thereof, said body having a plurality of spaced-apart openings formed therein each presenting a void area and a maximum transverse dimension d, the ratio d/D being at least about 0.4.

18. The roller of claim 17, the ratio d/D being from about 0.4–0.8.

19. The roller of claim 18, the ratio d/D being from about 0.5–0.7.

20. The roller of claim 17, the sum of the void areas of said openings being VA, the ratio VA/SA being from about 0.12–0.50.

21. The roller of claim 20, said ratio VA/SA being from about 0.16–20.

22. The roller of claim 17, at least one of said bearings having a plurality of through-areas formed therein permitting passage of cleaning fluid through the bearing.

23. A roller comprising:

an elongated, rotatable, tubular roller body presenting a length L, an outside diameter D, and a total surface area SA; and a pair of spaced-apart bearings supporting the body for said rotation thereof, said body having a plurality of spaced-apart openings formed therein each presenting a void area and a maximum transverse dimension d, the total void area presented by said openings being VA, the ratio VA/SA being from about 0.12–0.50.

24. The roller of claim 23, the ratio VA/SA being from about 0.16–20.

25. The roller of claim 23, at least one of said bearings having a plurality of through-areas formed therein permitting passage of cleaning fluid through the bearing.

26. In a web handling device including a plurality of elongated, axially rotatable, web-supporting rollers, the improvement which comprises using as at least one of said rollers, a roller including:

an elongated, rotatable, tubular roller body presenting a length L, an outside diameter D, and a total surface area SA; and a pair of spaced-apart bearings supporting the body for said rotation thereof, said body having a plurality of spaced-apart openings formed therein each presenting a void area and a maximum transverse dimension d, the ratio d/D being at least about 0.4.

27. The web handling device of claim 26, said web handling device forming a part of a labeling device.

28. In a web handling device including a plurality of elongated, axially rotatable, web-supporting rollers, the improvement which comprises using as at least one of said rollers, a roller including:

an elongated, rotatable, tubular roller body presenting a length L, an outside diameter D, and a total surface area SA; and a pair of spaced-apart bearings supporting the body for said rotation thereof, said body having a plurality of spaced-apart openings formed therein each presenting a void area and a maximum transverse dimension d, the total void area presented by said openings being VA, the ratio VA/SA being from about 0.12–0.50.

29. The web handling device of claim 28, said web handling device forming a part of a labeling device.

30. A labeling device comprising:

a label dispensing unit operable to deliver labels to a label delivery location; and a label transport and tamping assembly operable to receive labels from said unit and to apply the delivered labels to packages or the like, said assembly including a plurality of adjacent, hollow bodies each presenting a label-engaging end, said bodies shiftable between a label-receiving position and a label-applying position, and apparatus for creating reduced pressure conditions at said label-engaging ends when said bodies are in said label-receiving position thereof, said bodies comprising hollow plates located in side-by-side adjacency, each of said plates including internal baffle structure for evening airflow through the plates.

31. A labeling device comprising:

a label dispensing unit operable to deliver labels to a label delivery location; and a label transport and tamping assembly operable to receive labels from said unit and to apply the delivered labels to packages or the like, said assembly including a plurality of adjacent, hollow bodies each presenting a label-engaging end, said bodies shiftable between a label-receiving position and a label-applying position, and apparatus for creating reduced pressure conditions at said label-engaging ends when said bodies are in said label-receiving position thereof, said assembly including a belt assembly presenting a plurality of laterally spaced apart belts each having a label-supporting run and operable to move said labels from said delivery location to a label pickup location, said bodies being located between said belts for passage therethrough upon movement of the bodies between said label-receiving and label-applying positions.

32. A labeling method comprising the steps of:

moving labels to a label pickup location; and engaging said labels and moving the engaged labels from the pickup location to a label-applying location in order to apply the labels against packages or the like, said engaging and moving step comprising the steps of providing a plurality of adjacent, hollow bodies each presenting a label-engaging end, and shifting said bodies between a label-receiving position at said pickup location and a label-applying position, and creating reduced pressure conditions at said ends when the bodies are in the label-receiving position thereof, said bodies comprising hollow plates located in side-by-side adjacency, said reduced pressure creating step including the step of drawing air through the ends of said plates remote from said label-engaging ends thereof and causing said air drawn through said plates to traverse tortuous airflow paths through the plates.

33. A labeling method comprising the steps of:

moving labels to a label pickup location; and engaging said labels and moving the engaged labels from the pickup location to a label-applying location in order to apply the labels against packages or the like, said engaging and moving step comprising the steps of providing a plurality of adjacent, hollow bodies each presenting a label-engaging end, and shifting said bodies between a label-receiving position at said pickup location and a label-applying position, and creating reduced pressure conditions at said ends when the bodies are in the label-receiving position thereof, said bodies comprising hollow plates located in side-by-side adjacency, said assembly including a belt assembly presenting a plurality of laterally spaced apart belts each having a label-supporting run, said plates being located between said belts for passage therethrough upon movement of the plates between said label-receiving and label-applying positions.

34. A label tamping device comprising a plurality of adjacent, hollow plates located in side-by-side relationship and shiftable between a label-receiving position and a label-applying position, each of said plates presenting an open label-engaging end, an open remote end, and internal baffle structure for evening air flow through the plates, and apparatus located proximal to said remote ends for drawing air through said hollow plates in order to create reduced pressure conditions at said label-engaging ends.

* * * * *

UNITED STATES PATENT AND TRADEMARK OFFICE

CERTIFICATE OF CORRECTION

PATENT NO. : 6,868,887 B2 
DATED : March 22, 2005
INVENTOR(S) : James R. Harte and John Scott Nixon It is certified that error appears in the above-identified patent and that said Letters Patent is hereby corrected as shown below:

Title page,
Item [75], Inventors, replace "James A. Harte" with -- James R. Harte --.

Signed and Sealed this

Twelfth Day of July, 2005

JON W. DUDAS
*Director of the United States Patent and Trademark Office*